US009668548B2

(12) United States Patent
Keyaki et al.

(10) Patent No.: US 9,668,548 B2
(45) Date of Patent: Jun. 6, 2017

(54) SLIDER FOR SLIDE FASTENER

(71) Applicant: YKK Corporation, Tokyo (JP)

(72) Inventors: Keiichi Keyaki, Toyama (JP); Kouji Yamagishi, Toyama (JP); Yohei Miyazaki, Toyama (JP)

(73) Assignee: YKK Corporation (JP)

( * ) Notice: Subject to any disclaimer, the term of this patent is extended or adjusted under 35 U.S.C. 154(b) by 2 days.

(21) Appl. No.: 14/592,187

(22) Filed: Jan. 8, 2015

(65) Prior Publication Data

US 2015/0189955 A1 Jul. 9, 2015

Related U.S. Application Data

(63) Continuation of application No. 13/499,044, filed as application No. PCT/JP2009/067102 on Sep. 30, 2009, now Pat. No. 8,959,729.

(51) Int. Cl.

| | |
|---|---|
| ***A44B 19/26*** | (2006.01) |
| ***A47G 25/90*** | (2006.01) |
| ***E04H 15/64*** | (2006.01) |
| ***A41F 1/00*** | (2006.01) |
| ***E04H 15/32*** | (2006.01) |

(52) U.S. Cl.

CPC ..... *A44B 19/262* (2013.01); *A41F 1/008* (2013.01); *A44B 19/26* (2013.01); *A47G 25/902* (2013.01); *E04H 15/322* (2013.01); *E04H 15/64* (2013.01); *A41D 2300/322* (2013.01); *A41D 2300/33* (2013.01); *Y10T 24/2561* (2015.01); *Y10T 24/2582* (2015.01); *Y10T 24/2584* (2015.01); *Y10T 24/2586* (2015.01); *Y10T 24/2598* (2015.01)

(58) Field of Classification Search

CPC ... A44B 19/262; A44B 19/26; Y10T 24/2586; Y10T 24/2584; Y10T 24/2598; Y10T 24/2582; Y10T 24/2561; A47G 25/902; A41F 1/008; A41D 2300/322; A41D 2300/33; E04H 15/64; E04H 15/322

See application file for complete search history.

(56) References Cited

U.S. PATENT DOCUMENTS 5,416,951 A 5/1995 Keyaki et al.
5,689,860 A 11/1997 Matoba et al.
(Continued)

FOREIGN PATENT DOCUMENTS

CN 2459941 Y 11/2001
CN 2468332 Y 1/2002
(Continued)

OTHER PUBLICATIONS

International Search Report and Written Opinion, PCT International Application No. PCT/JP2009/067102, mailed Dec. 22, 2009.
(Continued)

*Primary Examiner* — Robert J Sandy
*Assistant Examiner* — Louis Mercado
(74) *Attorney, Agent, or Firm* — Kilpatrick Townsend & Stockton LLP

(57) ABSTRACT

A slider for a slide fastener is provided which is capable of quickly fastening and unfastening the slide fastener in a remote operation manner. A string having pull tabs on longitudinally opposite sides is fixed to a body of the slider for a slide fastener such that the string is not moved in the longitudinal direction.

9 Claims, 17 Drawing Sheets

(56) References Cited

U.S. PATENT DOCUMENTS

| | | | |
|---|---|---|---|
| 5,771,546 | A | 6/1998 | Minato |
| 5,829,105 | A | 11/1998 | Matoba et al. |
| D403,271 | S | 12/1998 | Ishii et al. |
| 5,878,467 | A | 3/1999 | Yokota |
| 5,911,369 | A | 6/1999 | Yamazaki |
| 5,930,874 | A | 8/1999 | Yamazaki et al. |
| 6,376,047 | B1 | 4/2002 | Hasegawa |
| 6,532,633 | B2 | 3/2003 | Chu |
| 6,596,106 | B2 | 7/2003 | Akashi et al. |
| 7,073,233 | B2 | 7/2006 | Leva et al. |
| 7,506,417 | B2 | 3/2009 | Yoneoka |
| 2002/0157172 | A1 | 10/2002 | Matsushima et al. |
| 2007/0107171 | A1 | 5/2007 | Kojima |
| 2010/0037438 | A1 | 2/2010 | Muratsubaki et al. |

FOREIGN PATENT DOCUMENTS

| | | | |
|---|---|---|---|
| CN | 1965717 | A | 5/2007 |
| JP | 1-187297 | A | 7/1989 |
| JP | 09-000319 | A | 1/1997 |
| JP | 3065370 | U | 2/2000 |
| JP | 3081306 | U | 11/2001 |
| JP | 2004-204376 | A | 7/2004 |
| WO | 2006/137293 | A1 | 12/2006 |

OTHER PUBLICATIONS

Office Action, Chinese Patent Application No. 200980161746.8, mailed Mar. 27, 2014.

SLIDER FOR SLIDE FASTENER

This application is a continuation of U.S. patent application Ser. No. 13/499,044, now U.S. Pat. No. 8,959,729, which is a national stage application of PCT/JP2009/067102, both of which are incorporated herein by reference.

TECHNICAL FIELD

The present invention relates to a slider for a slide fastener.

BACKGROUND ART

A slide fastener is used in a variety of fields such as clothes, sleeping bags, tents and the like. While the slide fastener generally performs the movement of fastening and unfastening by holding a pull tab with user's fingers and then sliding a slider, if the slide fastener is provided at a position such as e.g. the back of clothes, sleeping bags, etc. where it is difficult for the user's fingers to reach, the movement of fastening and unfastening is carried out by pulling a string engaging with the pull tab with a hook or the like. However, the engaging work of the hook with the pull tab is so troublesome that the slide fastener cannot be quickly fastened and unfastened.

There is known a slide fastener in which a slider is remotely controllable, wherein a string, both ends of which are fixed to a stopper and a pull tab, respectively, is arranged to pass through a through-hole provided in the slider, so that the slide fastener is fastened and unfastened by pulling the pull tab separated away from the slider to slide the slider (see e.g. Patent Document 1).

PRIOR ART DOCUMENT

Patent Document

Patent Document 1: Japanese Utility Model No. 3081306

SUMMARY OF INVENTION

Problems to be Solved by Invention

According to the slide fastener disclosed in the patent document 1, since the string can be freely moved in the through-hole, unless the string has been drawn in one direction until the stopper or the pull tab, which is fixed to the end of the string, comes into contact with the slider, the slider cannot be slid, the slide fastener cannot be quickly fastened and unfastened.

The present invention has been made keeping in mind the above problems occurring in the related art, and an object of the present invention is to provide a slider for a slide fastener, which is able to quickly fasten and unfasten the slide fastener in a remote operation manner.

Means for Solving Problems

The object of the present invention is achieved by the following configurations.

(1) A slider for a slide fastener including: a body which engages and disengages fastener elements of a pair of fastener stringers, wherein a string having pull tabs in longitudinally opposite sides thereof is fixed to the body.

(2) In the slider according to (1), the string is fixed to the body using a separate member.

(3) In the slider according to (2), the body includes upper and lower blades vertically disposed opposite to each other, and a guide post connecting the upper and lower blades, wherein at least one of the upper and lower blades is provided with an opening longitudinally passing therethrough so that the string is inserted into the opening, and fixture members are attached to the string adjacent frontal and rear portions of the opening to fix the string to the body.

(4) In the slider according to (2), the body includes upper and lower blades vertically disposed opposite to each other, and a guide post connecting the upper and lower blades, wherein at least one of the upper and lower blades is provided, in a surface thereof, with a string-receiving portion having therein a protrusion for fixing the string to receive therein the string, so that the string is fixed to the body following fitting and assembling a cover to the body in a state in which the string is placed in the string-receiving portion, the cover having therein a protrusion for fixing the string.

(5) In the slider according to (2), the body includes upper and lower blades vertically disposed opposite to each other, and a guide post connecting the upper and lower blades, wherein at least one of the upper and lower blades is provided, in a surface thereof, with a string-receiving portion having therein a protrusion for fixing the string to receive therein the string, so that the string is fixed to the body following fitting and assembling a cover to the string-receiving portion in a state in which the string is placed in the string-receiving portion, the cover having therein a protrusion for fixing the string.

(6) In the slider according to (2), the body includes upper and lower blades vertically disposed opposite to each other, and a guide post connecting the upper and lower blades, wherein at least one of the upper and lower blades is provided, in a surface thereof, with a string-receiving portion having therein a protrusion for fixing the string to receive therein the string, so that the string is fixed to the body following sliding and assembling a cover along and to the string-receiving portion in a state in which the string is placed in the string-receiving portion.

(7) In the slider according to (2), a body of the slider includes a lower blade, a pair of left and right flanges having an inverted L-shape in cross section, a guide post, and an element guide, wherein the pair of left and right flanges has a pair of left and right side wall portions erected along left and right side edges of the lower blade and a pair of left and right upper plate portions extending from upper ends of the left and right side wall portions in a mutually approaching direction, the guide post is erected extending from the frontal-sided transverse central portion of the lower blade between the pair of left and right upper plate portions, and the element guide is provided on an outer circumference of the guide post such that the element guide extends towards the inner end surfaces of the left and right upper plate portions, wherein the lower blade is provided with an opening longitudinally passing therethrough so that the string is inserted into the opening, and fixture members are attached to the string adjacent frontal and rear portions of the opening to fix the string to the body.

(8) In the slider according to (2), a body of the slider includes a lower blade, a pair of left and right flanges having an inverted L-shape in cross section, a guide post, and an element guide, wherein the pair of left and right flanges has a pair of left and right side wall portions erected along left and right side edges of the lower blade and a pair of left and right upper plate portions extending from upper ends of the left and right side wall portions in a mutually approaching direction, the guide post is erected extending from the frontal-sided transverse central portion of the lower blade between the pair of left and right upper plate portions, and the element guide is provided on an outer circumference of the guide post such that the element guide extends towards the inner end surfaces of the left and right upper plate portions, wherein the lower blade is provided, in a surface thereof, with a string-receiving portion having therein a protrusion for fixing the string to receive therein the string, so that the string is fixed to the body following fitting and assembling a cover to the body in a state in which the string is placed in the string-receiving portion, the cover having therein a protrusion for fixing the string.

(9) In the slider according to (2), a body of the slider includes a lower blade, a pair of left and right flanges having an inverted L-shape in cross section, a guide post, and an element guide, wherein the pair of left and right flanges has a pair of left and right side wall portions erected along left and right side edges of the lower blade and a pair of left and right upper plate portions extending from upper ends of the left and right side wall portions in a mutually approaching direction, the guide post is erected extending from the frontal-sided transverse central portion of the lower blade between the pair of left and right upper plate portions, and the element guide is provided on an outer circumference of the guide post such that the element guide extends towards the inner end surfaces of the left and right upper plate portions, wherein the lower blade is provided, in a surface thereof, with a string-receiving portion having therein a protrusion for fixing the string to receive therein the string, so that the string is fixed to the body following fitting and assembling a cover to the string-receiving portion in a state in which the string is placed in the string-receiving portion, the cover having therein a protrusion for fixing the string.

(10) In the slider according to (2), a body of the slider includes a lower blade, a pair of left and right flanges having an inverted L-shape in cross section, a guide post, and an element guide, wherein the pair of left and right flanges has a pair of left and right side wall portions erected along left and right side edges of the lower blade and a pair of left and right upper plate portions extending from upper ends of the left and right side wall portions in a mutually approaching direction, the guide post is erected extending from the frontal-sided transverse central portion of the lower blade between the pair of left and right upper plate portions, and the element guide is provided on an outer circumference of the guide post such that the element guide extends towards the inner end surfaces of the left and right upper plate portions, wherein the lower blade is provided, in a surface thereof, with a string-receiving portion having therein a protrusion for fixing the string to receive therein the string, so that the string is fixed to the body following sliding and assembling a cover along and to the string-receiving portion in a state in which the string is placed in the string-receiving portion.

(11) A tent including the slider according to one of (1) to (10).

(12) A cloth article including the slider according to one of (1) to (10).

Advantageous Effects of Invention

According to the slider for a slide fastener of the present invention, since the string having the pull tabs on opposite sides in the longitudinal direction is fixed to the body, a force to pull the string is directly applied to the body, so that the slider can be slid without a delay. Thereby, the slide fastener can be quickly fastened and unfastened in a remote operation manner. In addition, since the string can be fixed to an arbitrary position in the longitudinal direction, according to the use, the length of the string when fixed to the slider can be predetermined.

MODE TO CARRY OUT INVENTION

Hereinafter, a slider for a slide fastener according to each embodiment of the present invention will be described in detail with reference to the accompanying drawings. Meanwhile, in the respective embodiment, the longitudinal direction of the slider means the direction that is parallel to the sliding direction of the slider, the front direction refers to the direction in which the slider slides thereby to mesh left and right elements with respect to the slide fastener, and the rear direction refers to the direction in which the slider slides thereby to separate the meshed left and right elements with respect to the slide fastener. In addition, the lateral direction of the slider refers to the direction that is perpendicular to the longitudinal direction of the slider while being parallel to a fastener tape when the slide fastener is configured, and the vertical direction of the slider refers to the direction that is the same as the inside-outside direction of the fastener tape when the slide fastener is configured.

[First Embodiment]

A slider for a slide fastener according to a first embodiment of the present invention will first be described with reference to FIG. 1 to FIG. 5.

Figure 1:
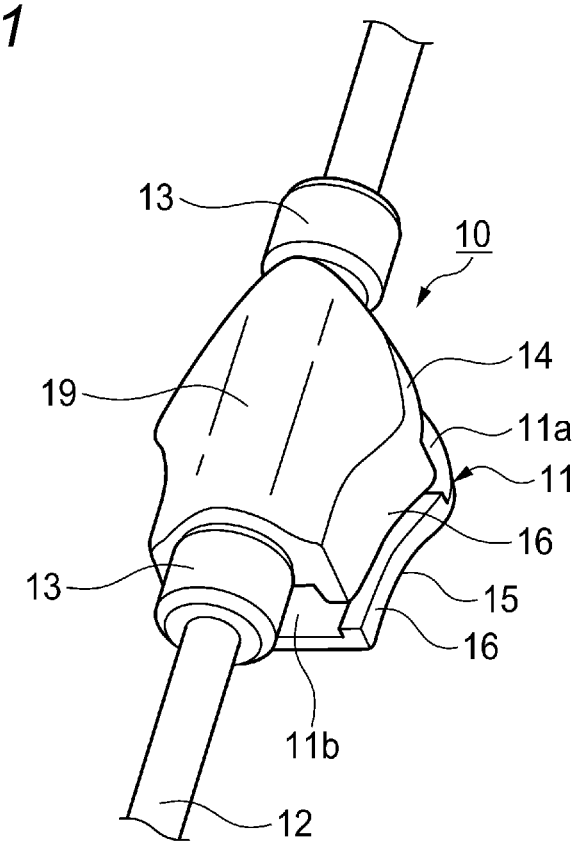
FIG. 1 is a perspective view showing a slider for a slide fastener according to a first embodiment of the present invention.

As shown in FIG. 1, the slider 10 for a slide fastener according to this embodiment includes a body 11 which fastens and unfastens fastener elements of a pair of left and right fastener stringers, which are not shown, a string 12 fixed to the body 11, and a pair of front and rear fixture members 13 which is configured separately from the body 11 to fix the string 12 to the body 11.

Figure 2:
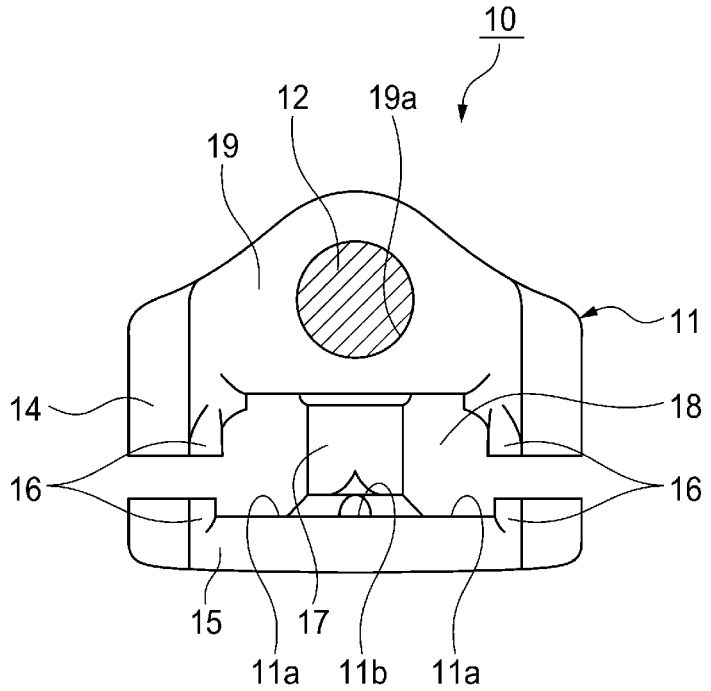
FIG. 2 is a partially-cut rear view of the slider for a slide fastener shown in FIG. 1.
Figure 3:
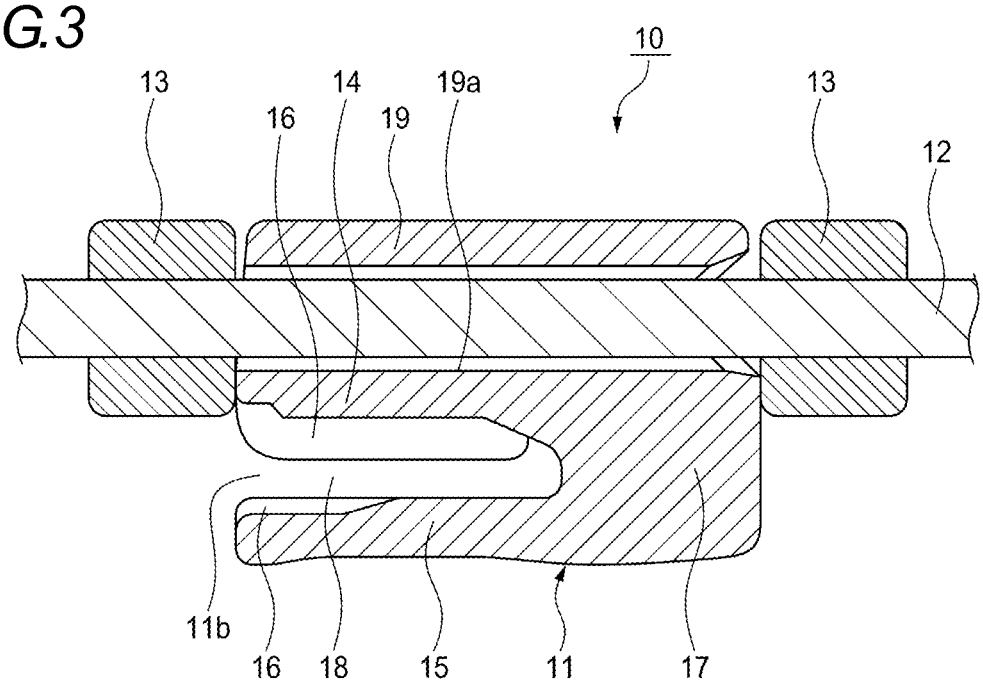
FIG. 3 is a cross-sectional view taken along a laterally central line of the slider for a slide fastener shown in FIG. 1.

As shown in FIG. 1 to FIG. 3, the body 11 includes upper and lower blades 14 and 15, which are arranged parallel and opposite to each other in the vertical direction, a pair of left and right flanges 16, which is provided along both side edges of the upper and lower blades 14 and 15, and a guide post 17 which connects the upper and lower blades 14 and 15 at frontal ends thereof. At a frontal side portion of the body 11, left and right shoulder mouths 11*a* which are divided by the guide post 17 are provided, and at a rear side portion of the body 11, a rear mouth 11*b* is provided. Further, between the upper blade 14 and lower blade 15, a substantially Y-type element guide passage 18 is provided which communicates with the left and right shoulder mouths 11*a* and the rear mouth 11*b*.

As shown in FIG. 2 and FIG. 3, a mountain-shaped portion 19 having a triangular shape in cross section is integrally formed on a surface of the upper blade 14, and an opening 19*a* is longitudinally formed in the mountain-shaped portion 19 to thread the string 12 therethrough.

The string 12 is threaded into the opening 19*a* of the mountain-shaped portion 19, and is provided on opposite ends thereof with pull tabs which are not shown. Meanwhile, the pull tab may be separately formed and be attached to the end of the string 12, or otherwise may be injection-molded on the end of the string 12 with resin. In addition, the string may be a string without the pull tabs.

The fixture member 13 is a cylindrical member that is made of resin, metal, or the like. The fixture members are fixedly connected onto the string 12 adjacent to frontal and rear ends of the opening 19*a* of the body 11 such that the string 12 cannot be longitudinally moved in the opening 19*a*. In order to fix the fixture member 13 to the string 12, the fixture member, if made of resin, may be directly injection molded onto the string 12, or the fixture member, if made of metal, may be fixed to the string 12 using a caulking method.

In the slider 10 for a slide fastener configured as such, the string 12 is fixed to the body 11 by threading the string 12 into the opening 19*a* of the body 11 and fixing the fixture members 13 onto the string 12 in the proximity of the frontal and rear portions of the body 11 (opening 19*a*). The length of the string 12 that extends in the longitudinal direction from the body 11 may be arbitrarily determined according to the fixing positions of the pair of front and rear fixture members 13 with respect to the string 12.

As set forth before, according to the slider 10 for a slide fastener, since the slider is configured such that the mountain-shaped portion 19 formed on the upper blade 14 is provided with the opening 19*a* that longitudinally extends through the mountain-shaped portion 19, so that when the string 12 is threaded through the opening 19*a* and the fixture members 13 are fixed onto the string 12 in the proximity of the frontal and rear portions of the opening 19*a*, the string 12 is fixed to the body 11 without the string 12 being longitudinally (the lengthwise direction of the string 12) moved in the slider 10, a force to pull the string 12 is directly applied to the body 11, so that the slider 10 can be slid without a delay. Thereby, the slide fastener can be quickly fastened and unfastened in a remote operation manner. In addition, since the string 12 can be fixed to an arbitrary position in the longitudinal direction, according to the use, the length of the string 12 when fixed to the slider 10 can be predetermined.

Figure 4:
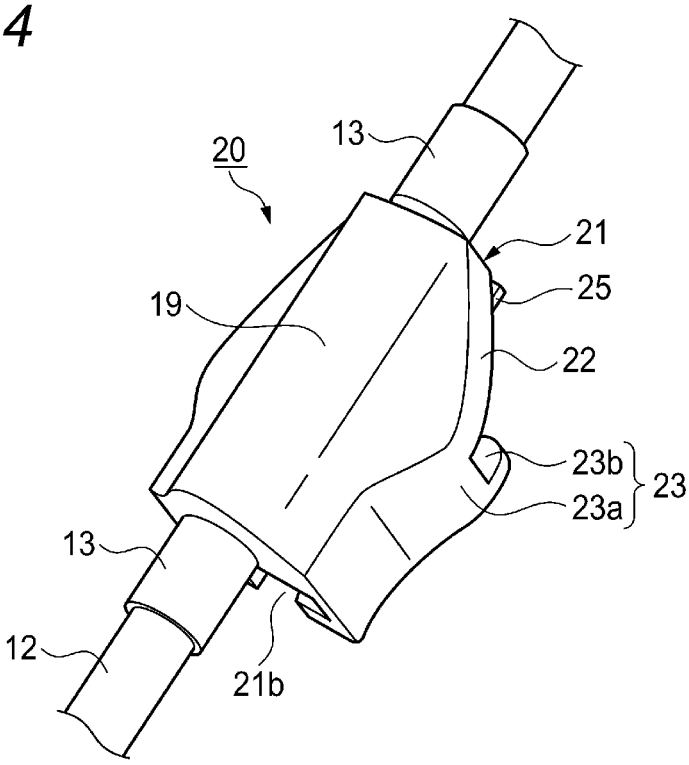
FIG. 4 is a perspective view showing a modification of the slider for a slide fastener according to the first embodiment when is viewed from the top.
Figure 5:
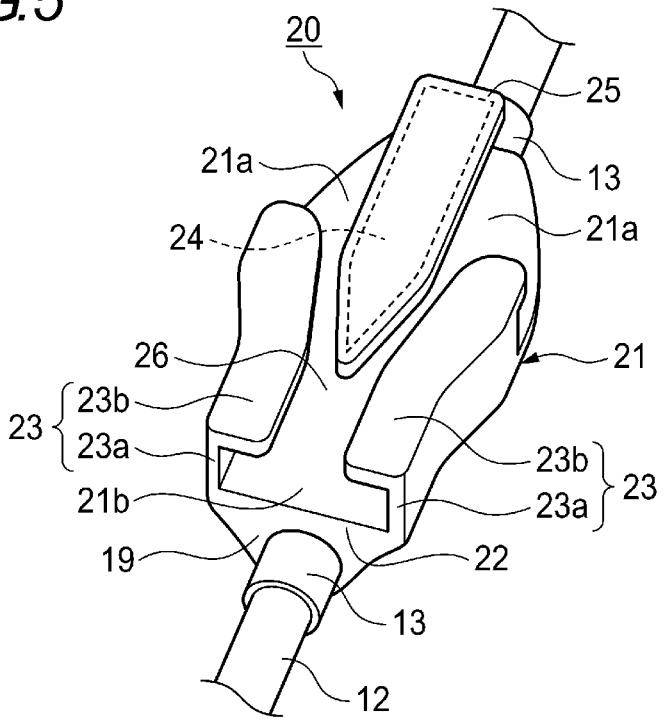
FIG. 5 is a perspective view showing the slider for a slide fastener shown in FIG. 4 when is viewed from the bottom.

Meanwhile, as shown in FIG. 4 and FIG. 5, the string-fixing structure may be applied to a slider 20 for a concealed slide fastener that is a modification of the present embodiment. A body 21 of the slider 20 for a concealed slide fastener includes a lower blade 22, a pair of left and right flanges 23 having an inverted L-shape in cross section, a guide post 24, and an element guide 25. The pair of left and right flanges 23 has a pair of left and right side wall portions 23*a* erected along left and right side edges of the lower blade 22 and a pair of left and right upper plate portions 23*b* extending from upper ends of the left and right side wall portions 23*a* in a mutually approaching direction. The guide post 24 is erected extending from the frontal-sided transverse central portion of the lower blade 22 between the pair of left and right upper plate portions 23*b*. The element guide 25 is provided on an outer circumference of the guide post 24 such that the element guide extends towards the inner end surfaces of the left and right upper plate portions 23*b*. Further, at a frontal side portion of the body 21, left and right shoulder mouths 21*a* which are divided by the guide post 24 are provided, and at a rear side portion of the body 21, a rear mouth 21*b* is provided. Further, between the lower blade 22 and the pair of left and right upper plate portions 23*b*, a substantially Y-type element guide passage 26 is provided which communicates with the left and right shoulder mouths 21*a* and the rear mouth 21*b*. In the present modified embodiment, a mountain-shaped portion 19 having an opening 19*a* passing therethrough is integrally formed on the surface of the lower blade 22.

[Second Embodiment]

A slider for a slide fastener according to a second embodiment of the present invention will be described with reference to FIG. 6 to FIG. 11. Meanwhile, identical or similar parts with respect to the first embodiment are designated as the same reference signs, and a description thereof will be omitted or simplified.

Figure 6:
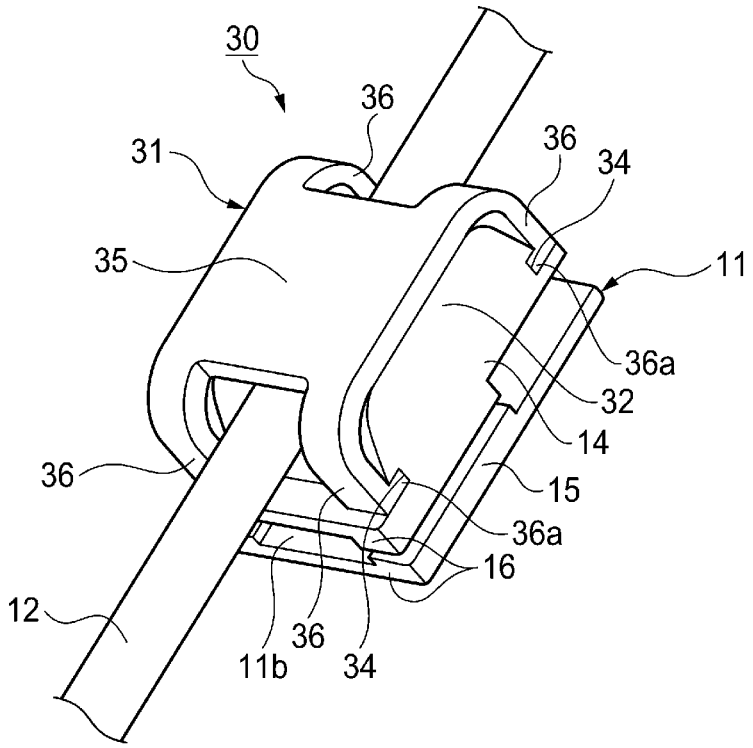
FIG. 6 is a perspective view showing a slider for a slide fastener according to a second embodiment of the present invention.
Figure 7:
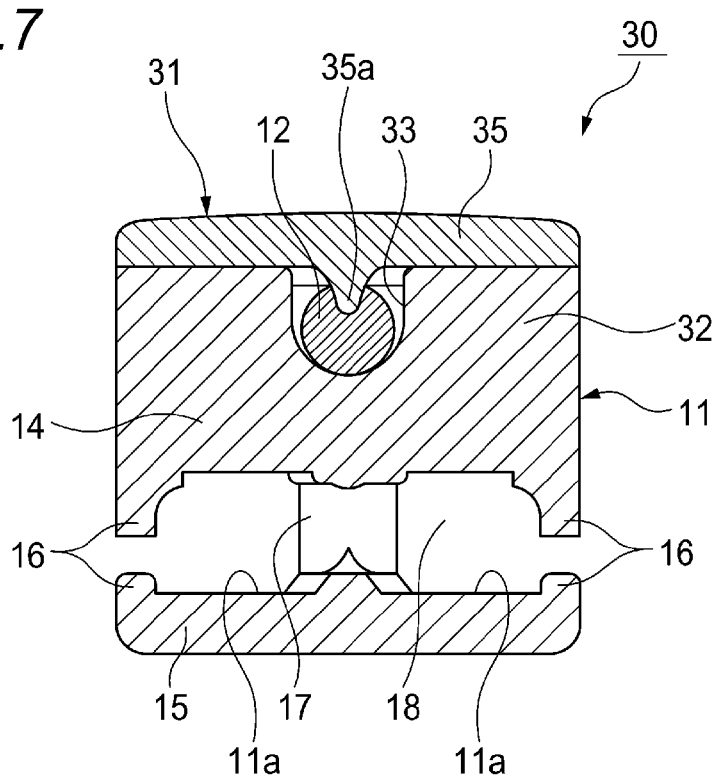
FIG. 7 is a cross-sectional view taken along a longitudinally center line of the slider for a slide fastener shown in FIG. 6.
Figure 8:
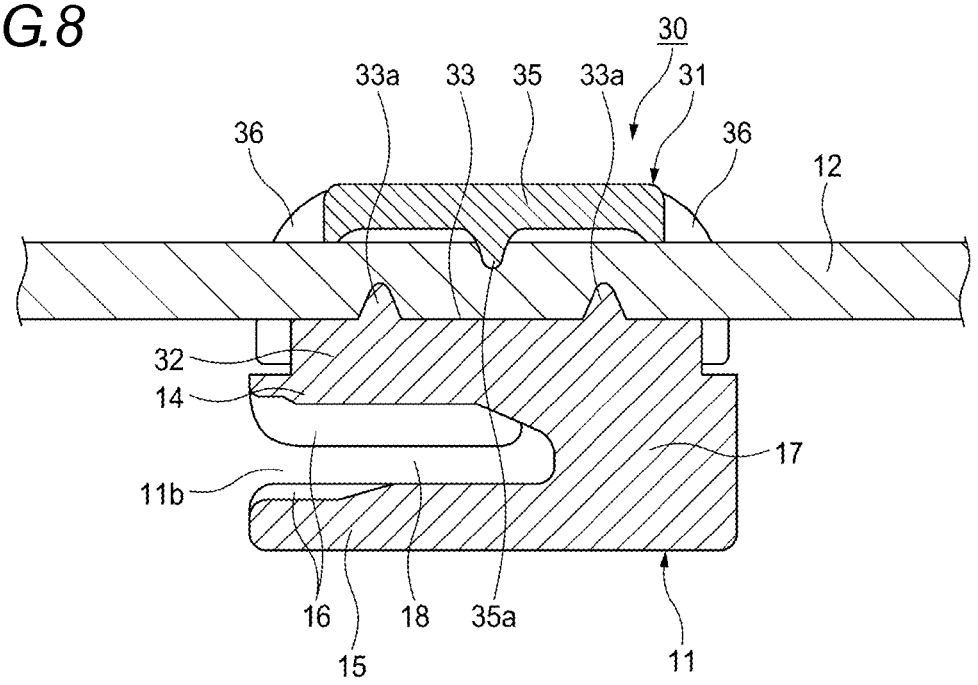
FIG. 8 is a cross-sectional view taken along a laterally center line of the slider for a slide fastener shown in FIG. 6.

As shown in FIG. 6 to FIG. 8, the slider 30 for a slide fastener according to this embodiment includes a body 11, a string 12, and a cover 31 which is configured separately from the body 11 to fix the string 12 to the body 11.

Figure 9:
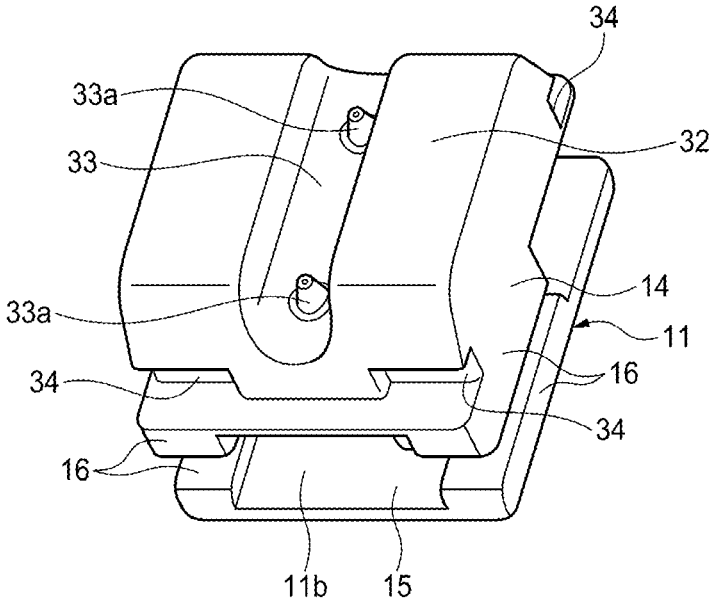
FIG. 9 is a perspective view showing a body shown in FIG. 6.

As shown in FIG. 7 to FIG. 9, a base portion 32 having a substantially rectangular shape is integrally formed on the entire surface of an upper blade 14, with a substantially U-shaped string-receiving groove (a string-receiving portion) 33 for receiving a string 12 longitudinally formed at the transverse central portion thereof. In addition, two protrusions 33*a* are separately formed in the longitudinal direction on the bottom of the string-receiving groove 33 in order to fix the string 12. Further, two pair of left and right engaging grooves 34 are respectively formed adjacent the frontal and rear ends and the left and right ends of the upper blade 14 such that two engaging grooves are arranged at the frontal and rear ends, respectively, in order to fasten the cover 31 to the upper blade 14.

Figure 10A:
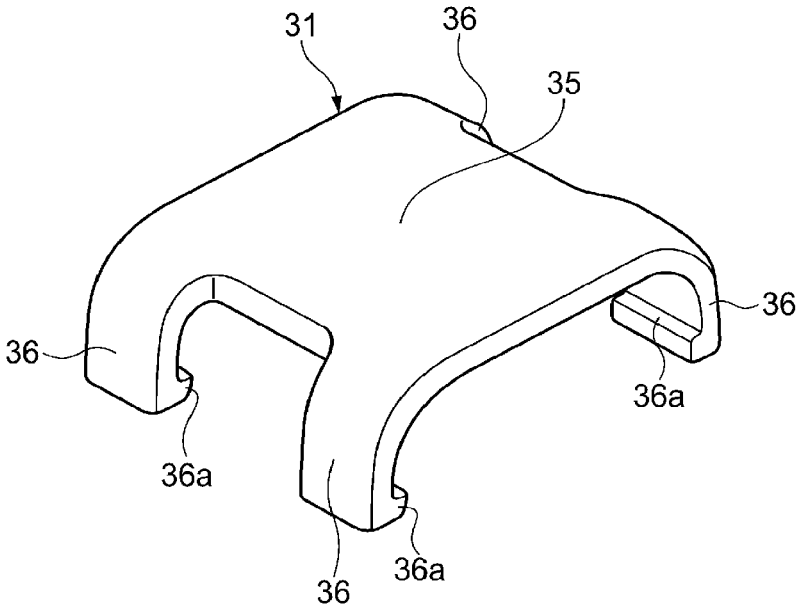
FIG. 10(*a*) and FIG. 10(*b*) are perspective views of a cover part shown in FIG. 6 when is viewed from the outside and a rear side.
Figure 10B:
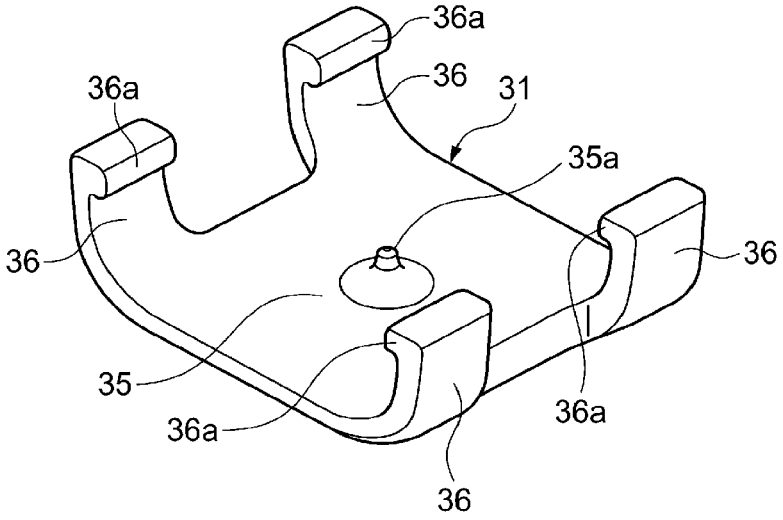

As shown in FIG. 6 and FIG. 10, the cover 31 is a planar member having a substantially H-shape when viewed from the top. The cover has a top plate portion 35 serving as the top, and two pair of left and right leg portions 36 respectively extending downwards from the frontal and rear ends of the top plate portion 35. In addition, engaging protrusions 36*a* which will engage with the pair of the left and right engaging grooves 34 respectively protrude from leading ends of the pair of left and right leg portions 36. Further, a protrusion 35*a* is formed on a substantially central portion of an undersurface of the top plate portion 35 in order to fix the string 12.

In the slider 30 for a slide fastener configured as such, the string 12 is fixed to the body 11 by arranging the string 12 into the string-receiving groove 33 of the body 11 and then assembling the cover 31 with the base portion 32 such that the engaging protrusions 36*a* of the cover 31 engage with the engaging grooves 34 of the upper blade 14 so that the string 12 is held between the two protrusions 33*a* of the string-receiving groove 33 and the protrusion 35*a* of the cover 31. The length of the string 12 that longitudinally extends from the body 11 may be arbitrarily predetermined according to the fixing positions of the slider 30 with respect to the string 12. In addition, the cover 31 is configured to be detachably assembled with the body 11 such that the cover 31 can be disassembled therefrom by releasing the engagement between the engaging grooves 34 and the engaging protrusions 36*a*.

As described before, according to the slider 30 for a slide fastener, since the slider is configured such that the string-receiving groove 33 having therein the protrusion 33*a* for fixing the string 12 is formed in the surface of the upper blade 14 so as to receive the string 12, so that when the string 12 is arranged in the string-receiving groove 33 and the cover 31 having therein the protrusion 35*a* for fixing the string 12 is fitted to and assembled with the body 11, the string 12 is fixed to the body 11, a force to pull the string 12 is directly applied to the body 11, so that the slider 30 can be slid without a delay. Thereby, the slide fastener can be quickly fastened and unfastened in a remote operation manner. In addition, since the string 12 can be fixed to an arbitrary position in the longitudinal direction, according to the use, the length of the string 12 when fixed to the slider 30 can be predetermined.

According to the slider 30 for a slide fastener of the present embodiment, since the cover 31 is configured to be detachable assembled with respect to the body 11, the length of the string 12 can be regulated even several times according to the circumstances where the string is used. Thereby, the operability of the slider 30 can be improved. The other construction is the same as that of the first embodiment.

Figure 11:
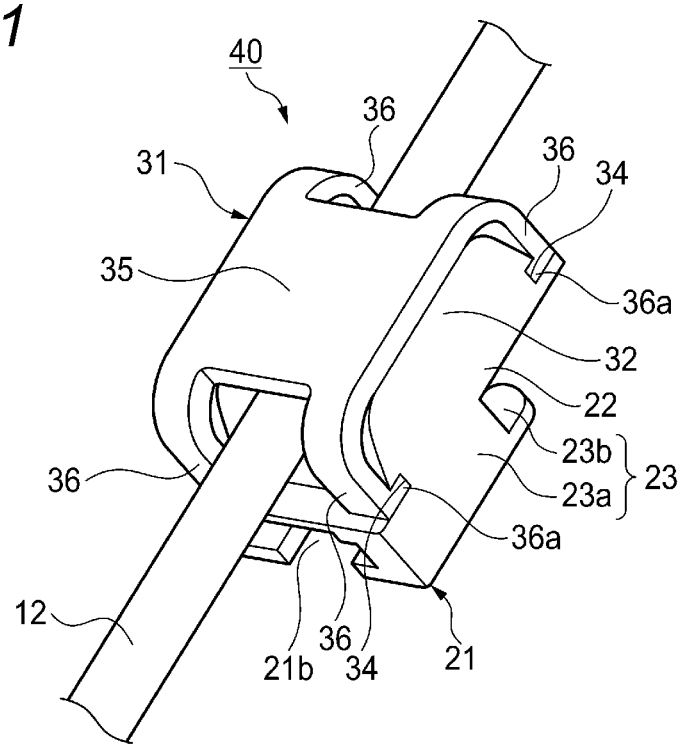
FIG. 11 is a perspective view showing a modification of the slider for a slide fastener according to the second embodiment.

Meanwhile, as shown in FIG. 11, the string-fixing structure may be applied to a slider 40 for a concealed slide fastener that is a modification of the present embodiment. A body 21 of the slider 40 for a concealed slide fastener has the same structure as the first embodiment, except that in the modified embodiment, a base portion 32 having a string-receiving groove 33 is integrally formed on the surface of a lower blade 22.

[Third Embodiment]

Next, a slider for a slide fastener according to a third embodiment of the present invention will be described with reference to FIG. 12 to FIG. 18. Meanwhile, identical or similar parts with respect to the first embodiment are designated as the same reference signs, and a description thereof will be omitted or simplified.

Figure 12:
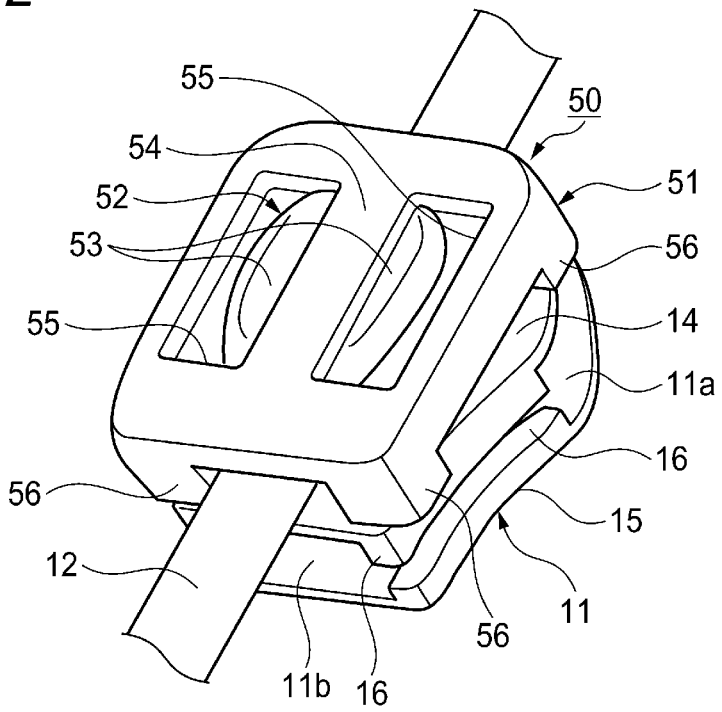
FIG. 12 is a perspective view showing a slider for a slide fastener according to a third embodiment of the present invention.
Figure 13:
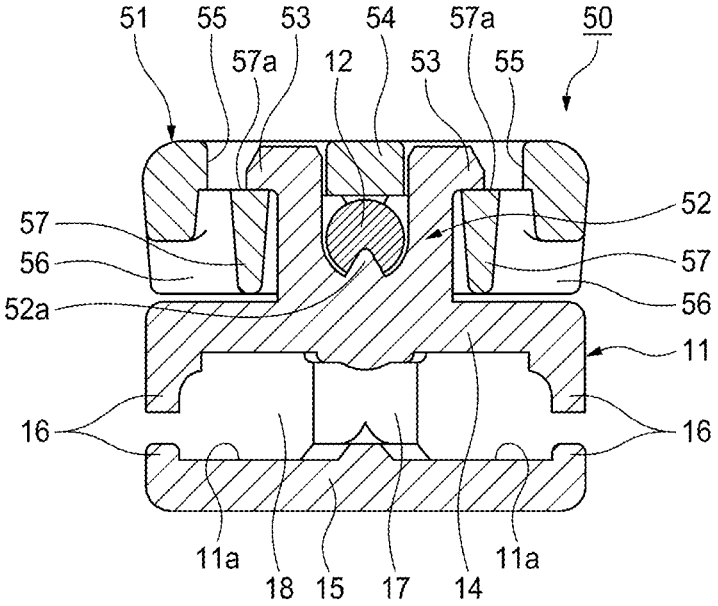
FIG. 13 is a cross-sectional view taken along a longitudinally center line of the slider for a slide fastener shown in FIG. 12.
Figure 14:
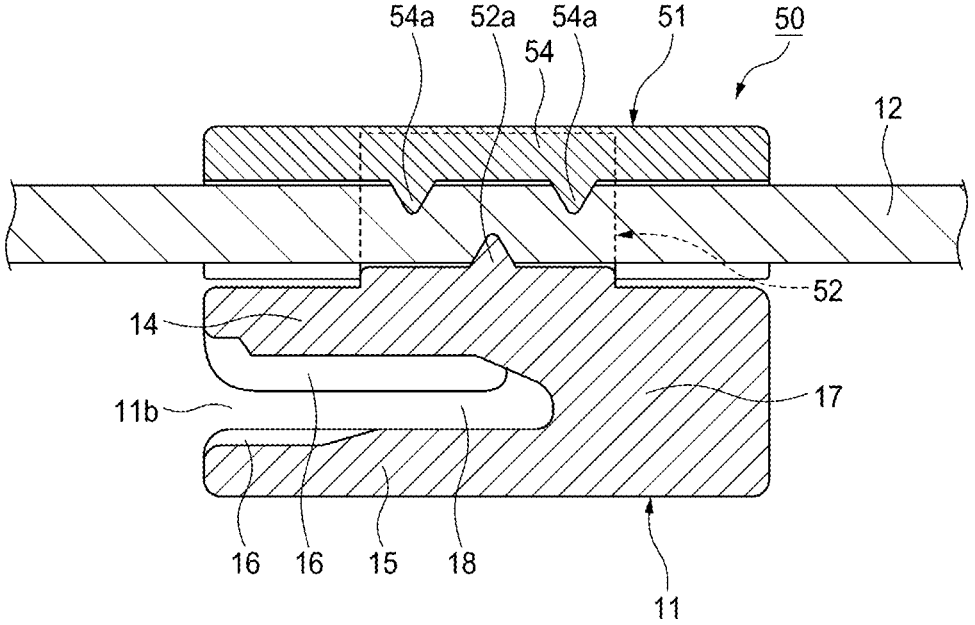
FIG. 14 is a cross-sectional view taken along a laterally center line of the slider for a slide fastener shown in FIG. 12.

As shown in FIG. 12 to FIG. 14, the slider 50 for a slide fastener according to this embodiment includes a body 11, a string 12, and a cover 51 which is configured separately from the body 11 to fix the string 12 to the body 11.

Figure 15:
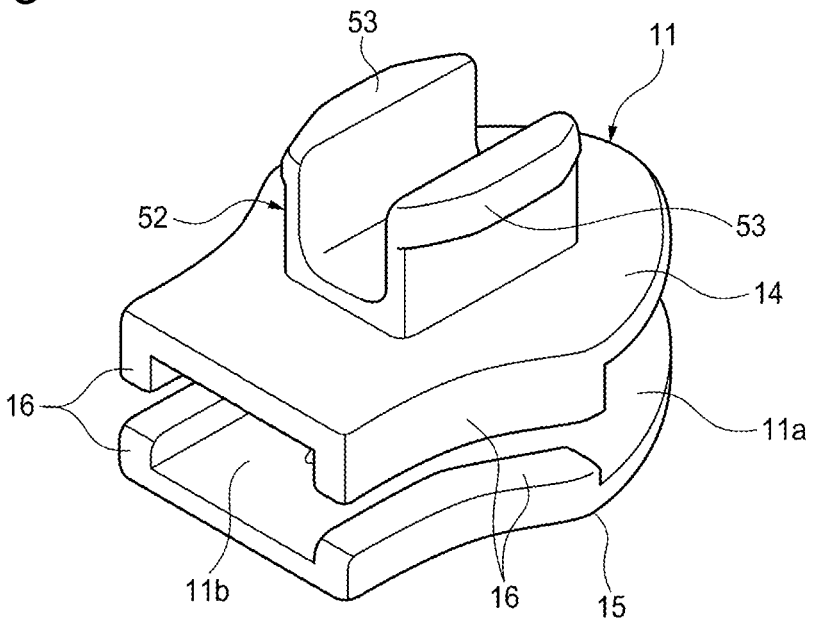
FIG. 15 is a perspective view showing a body shown in FIG. 12.

As shown in FIG. 13 to FIG. 15, a substantially U-shaped string-receiving portion 52 is longitudinally formed at a substantially central portion of the surface of an upper blade 14, wherein the string-receiving portion has a pair of substantially rectangular wall portions that extend in the longitudinal direction to receive the string 12. In addition, a protrusion 52*a* is formed on the bottom of the string-receiving portion 52 in order to fix the string 12. Further, a pair of left and right engaging portions 53 extends in the mutually receding direction from upper ends of the pair of rectangular wall portions to fasten the cover 51 to the string-receiving portion 52.

Figure 16A:
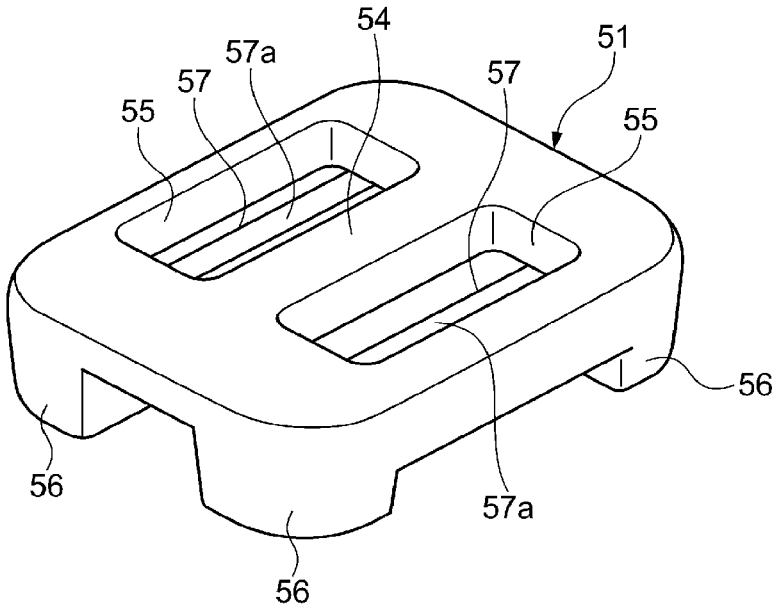
FIG. 16(*a*) and FIG. 16(*b*) are perspective views of a cover part shown in FIG. 12 when is viewed from the outside and a rear side.
Figure 16B:
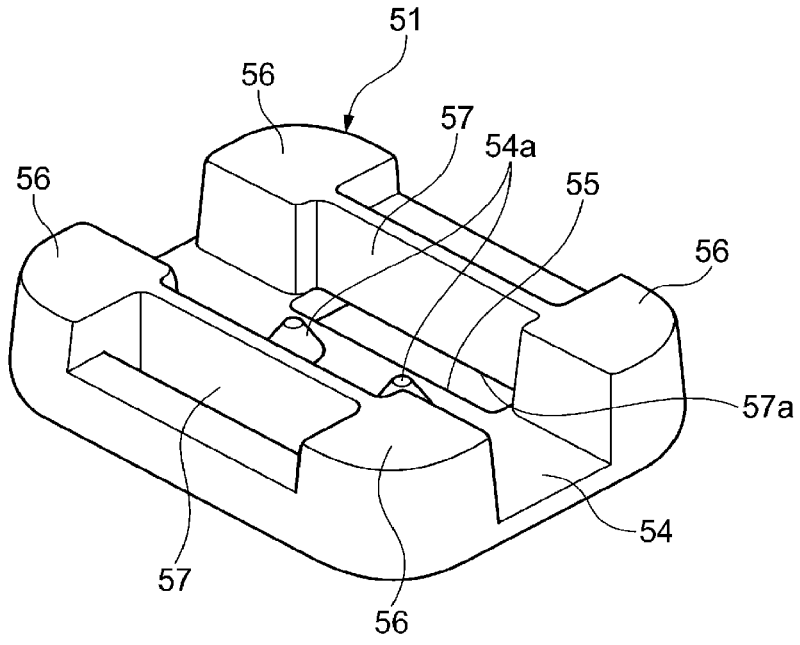

As shown in FIG. 12, FIG. 13, and FIG. 16, the cover 51 includes a top plate portion 54 having a substantially rectangular planar shape when viewed from the top, a pair of left and right openings 55 longitudinally formed in the top plate portion 54, two pair of left and right block portions 56 respectively extending downwards from the frontal and rear ends of the top plate portion through the openings 55 in an undersurface of the top plate portion 54, and a pair of left and right beam-shaped counter-engaging portions 57 which connects the block portions 56 of the left and right sides, respectively, of the top plate portion 54 and engages with the pair of left and right engaging portions 53 of the string-receiving portion 52. In addition, two protrusions 54*a* for fixing the string 12 are separately formed in the longitudinal direction at a substantially transverse central portion of the undersurface of the top plate portion 54.

In the slider 50 for a slide fastener configured as such, the string 12 is fixed to the body 11 by arranging the string 12 into the string-receiving portion 52 of the body 11 and then assembling the cover 51 with the upper blade 14 such that the left and right engaging portions 53 of the string-receiving portion 52 are pushed towards the openings 55 from the transverse inside portion of the counter-engaging portions 57 so as to engage with the left and right counter-engaging portions 57 of the cover 51 at engaging surfaces 57*a* that are upper surfaces of the counter-engaging portions 57 so that the string 12 is held between the protrusion 52*a* of the string-receiving portion 52 and the two protrusions 54*a* of the cover 51. The length of the string 12 that longitudinally extends from the body 11 may be arbitrarily predetermined according to the fixing positions of the slider 50 with respect to the string 12.

As described before, according to the slider 50 for a slide fastener, since the slider is configured such that the string-receiving portion 52 having therein the protrusion 52*a* for fixing the string 12 is formed in the surface of the upper blade 14 so as to receive the string 12, so that when the string 12 is arranged in the string-receiving portion 52 and the cover 51 having therein the protrusion 54*a* for fixing the string 12 is fitted to and assembled with the string-receiving portion 52, the string 12 is fixed to the body 11, a force to pull the string 12 is directly applied to the body 11, so that the slider 50 can be slid without a delay. Thereby, the slide fastener can be quickly fastened and unfastened in a remote operation manner. In addition, since the string 12 can be fixed to an arbitrary position in the longitudinal direction, according to the use, the length of the string 12 when fixed to the slider 50 can be predetermined. The other construction is the same as that of the first embodiment.

Figure 17:
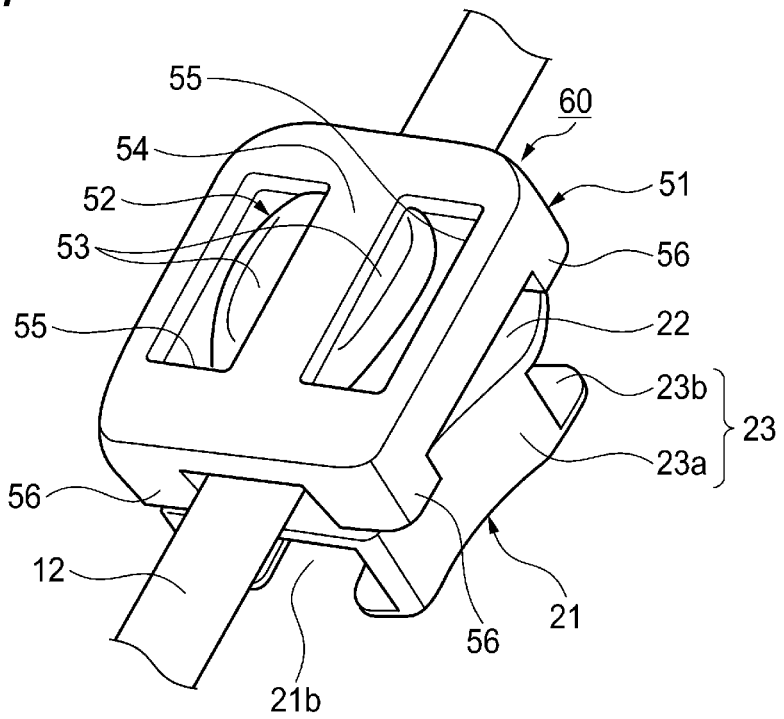
FIG. 17 is a perspective view showing a first modification of the slider for a slide fastener according to the third embodiment.

Meanwhile, as shown in FIG. 17, the string-fixing structure may be applied to a slider 60 for a concealed slide fastener that is a first modification of the present embodiment. A body 21 of the slider 60 for a concealed slide fastener has the same structure as the first embodiment, except that in the modified embodiment, a string-receiving portion 52 is formed in the surface of a lower blade 22.

Figure 18:
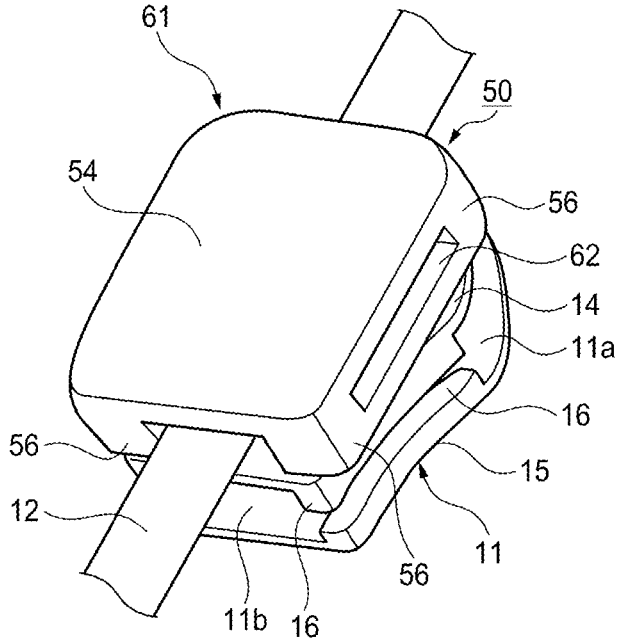
FIG. 18 is a perspective view showing a second modification of the slider for a slide fastener according to the third embodiment.

Further, as a second modification of the present embodiment, as shown in FIG. 18, a cover 61 may be used instead of the cover 51. The cover 61 is configured so that a top plate portion 54 is made thicker such that the opening 55 is closed, and so that punching holes 62 are formed in the transverse direction from left and right side edges of the cover 61, thereby forming an engaging surface 57*a* of a pair of left and right counter-engaging portions 57. Thereby, since the opening 55 is not exposed to the outside, an outer appearance of the slider 50 is improved. Meanwhile, the cover 61 of this embodiment may be adapted to the slider 60 for a concealed slide fastener of the first modified embodiment.

[Fourth Embodiment]

Next, a slider for a slide fastener according to a fourth embodiment of the present invention will be described with reference to FIG. 19 to FIG. 24. Meanwhile, identical or similar parts with respect to the first embodiment are designated as the same reference signs, and a description thereof will be omitted or simplified.

Figure 19:
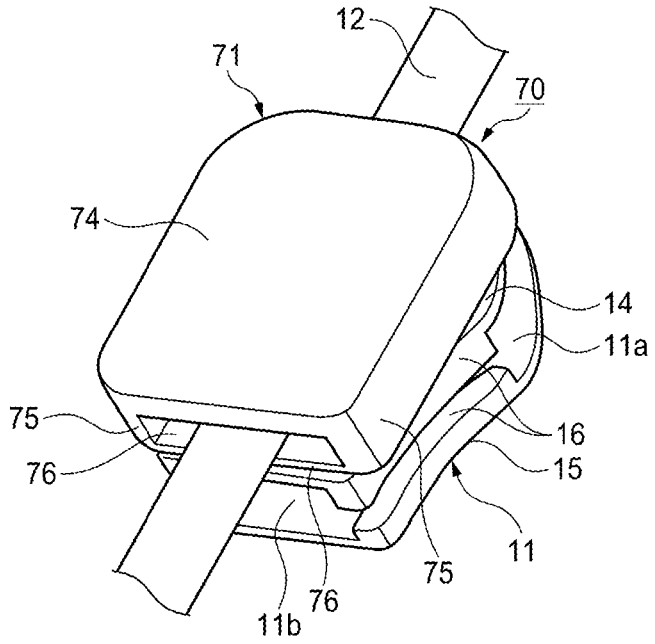
FIG. 19 is a perspective view showing a slider for a slide fastener according to a fourth embodiment of the present invention.
Figure 20:
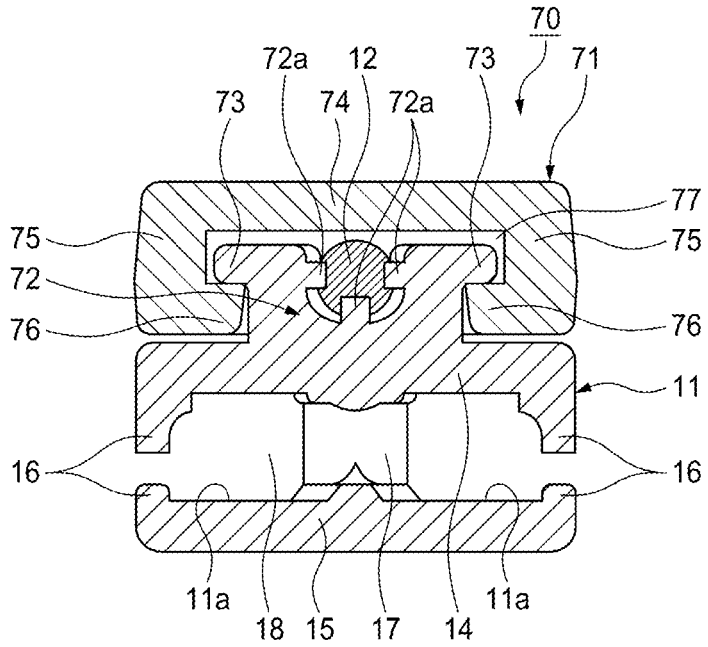
FIG. 20 is a cross-sectional view taken along a longitudinally center line of the slider for a slide fastener shown in FIG. 19.
Figure 21:
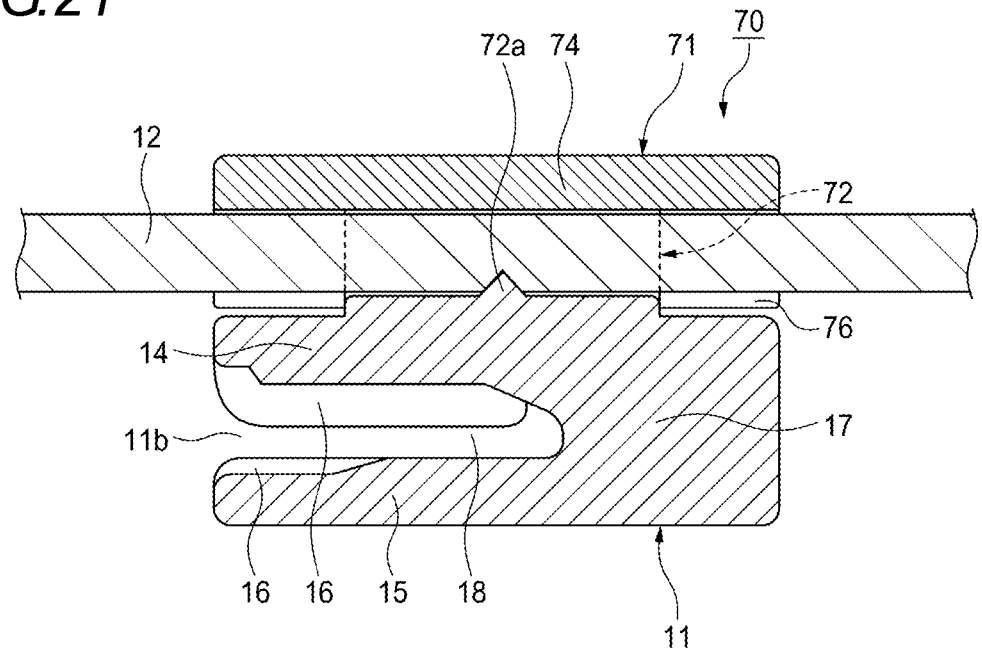
FIG. 21 is a cross-sectional view taken along a laterally center line of the slider for a slide fastener shown in FIG. 19.

As shown in FIG. 19 to FIG. 21, the slider 70 for a slide fastener according to this embodiment includes a body 11, a string 12, and a cover 71 which is configured separately from the body 11 to fix the string 12 to the body 11.

Figure 22:
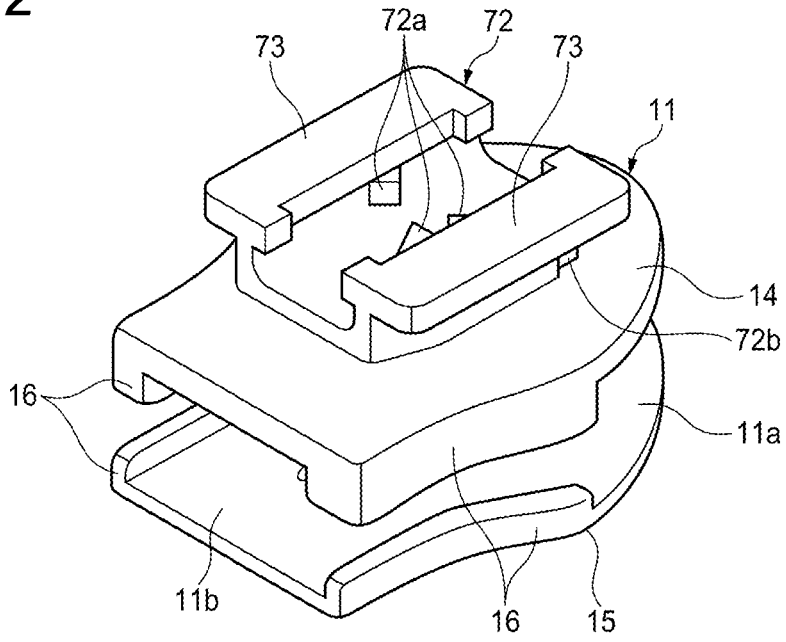
FIG. 22 is a perspective view showing a body shown in FIG. 19.

As shown in FIG. 20 to FIG. 22, a substantially U-shaped string-receiving portion 72 is longitudinally formed at a substantially central portion of the surface of an upper blade 14, wherein the string-receiving portion has a pair of substantially rectangular wall portions that extend in the longitudinal direction to receive the string 12. In addition, a protrusion 72*a* is formed on the bottom and opposite inner surfaces, respectively, of the string-receiving portion 72 in order to fix the string 12. Further, a pair of left and right engaging protrusions 73 extends in the mutually receding direction from upper ends of the pair of rectangular wall portions of the string-receiving portion 72 to fasten the cover 71 to the string-receiving portion 72.

Figure 23A:
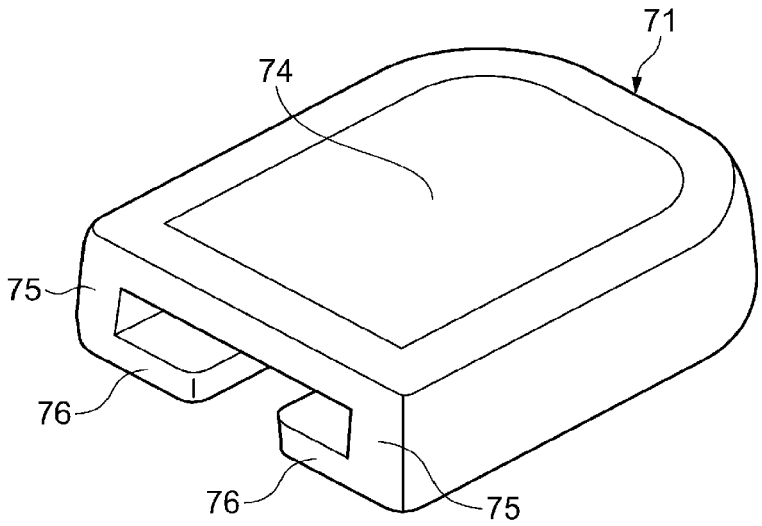
FIG. 23(*a*) and FIG. 23(*b*) are perspective views of a cover part shown in FIG. 19 when is viewed from the outside and a rear side.
Figure 23B:
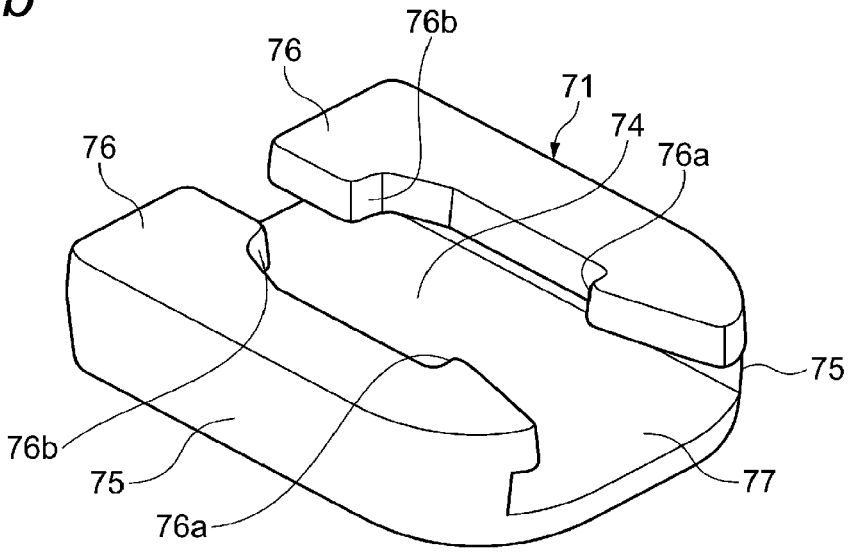

As shown in FIG. 19, FIG. 20, and FIG. 23, the cover 71 includes a top plate portion 74 that is a substantially rectangular plate member when viewed from the top, a pair of left and right side wall portions 75 extending downwards from left and right side edges of the top plate portion 74, and a pair of left and right counter-engaging portions 76 that extends from lower ends of the pair of the left and right side wall portions 75 in the mutually approaching direction parallel with the top plate portion 74 so as to engage with the pair of left and right engaging protrusions 73 of the string-receiving portion 72. In addition, an insertion opening 77 is formed in a frontal end of the cover 71, wherein the insertion opening is defined by the top plate portion 74, the left and right side wall portions 75, and the left and right counter-engaging portions 76 so that the string-receiving portion 72 is inserted into the cover 71 therethrough.

As shown in FIG. 23(*b*), the left and right counter-engaging portions 76 are provided in the frontal ends thereof with a pair of left and right engaging protrusions 76*a* to engage with a pair of left and right engaging ends 72*b* (FIG. 22) formed on opposite side portions of the string-receiving portion 72. In addition, the left and right counter-engaging portions 76 are provided in the rear end with a pair of left and right stoppers 76*b* to engage with the rear end of the string-receiving portion 72 so as to block the sliding movement of the cover 71.

In the slider 70 for a slide fastener configured as such, the string 12 is fixed to the body 11 by arranging the string 12 into the string-receiving portion 72 of the body 11 while being held between the three protrusions 72*a* and then sliding the cover 71 along the string-receiving portion 72 from the rear side towards the front side so that the string-receiving portion 72 is inserted into the insertion opening 77 of the cover 71, allowing lower surfaces of the left and right engaging protrusions 73 of the string-receiving portion 72 to engage with the upper surfaces of the left and right counter-engaging portions 76 of the cover 71. Here, the left and right protrusions 76*a* of the cover 71 are slid and engaged in an elastically-deformed manner with the left and right engaging ends 72*b* of the string-receiving portion 72 such that the stoppers 76*b* of the cover come into contact with the rear surface of the string-receiving portion 72, thereby fixing the cover 71 to the string-receiving portion 72. The length of the string 12 that longitudinally extends from the body 11 may be arbitrarily predetermined according to the fixing positions of the slider 70 with respect to the string 12.

As described before, according to the slider 70 for a slide fastener, since the slider is configured such that the string-receiving portion 72 having therein the protrusion 72*a* for fixing the string 12 is formed in the surface of the upper blade 14 so as to receive the string 12, so that when the string 12 is arranged in the string-receiving portion 72 and the cover 71 is slid along and engaged with the string-receiving portion 72, the string 12 is fixed to the body 11, a force to pull the string 12 is directly applied to the body 11, so that the slider 70 can be slid without a delay. Thereby, the slide fastener can be quickly fastened and unfastened in a remote operation manner. In addition, since the string 12 can be fixed to an arbitrary position in the longitudinal direction, according to the use, the length of the string 12 when fixed to the slider 70 can be predetermined. The other construction is the same as that of the first embodiment.

Figure 24:
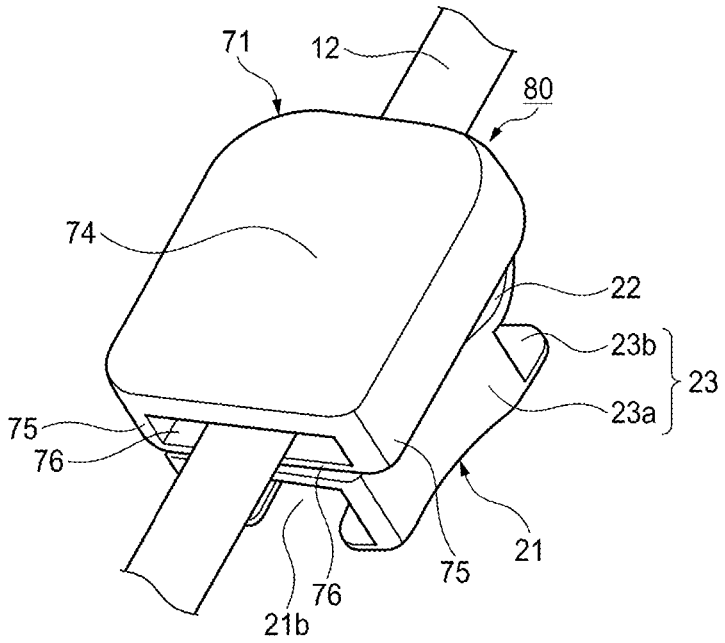
FIG. 24 is a perspective view showing a modification of the slider for a slide fastener according to the fourth embodiment.

Meanwhile, as shown in FIG. 24, the string-fixing structure may be applied to a slider 80 for a concealed slide fastener that is a modification of the present embodiment. A body 21 of the slider 80 for a concealed slide fastener has the same structure as the first embodiment, except that in the modified embodiment, a string-receiving portion 72 is formed in the surface of a lower blade 22.

Now a description will be made of examples of use of the slider 10, 20, 30, 40, 50, 60, 70, and 80 for a slide fastener according to the present invention with reference to FIG. 25 to FIG. 27. For easy understanding, the slider 10 for a slide fastener is used as a representative embodiment in describing the examples of use.

Figure 25:
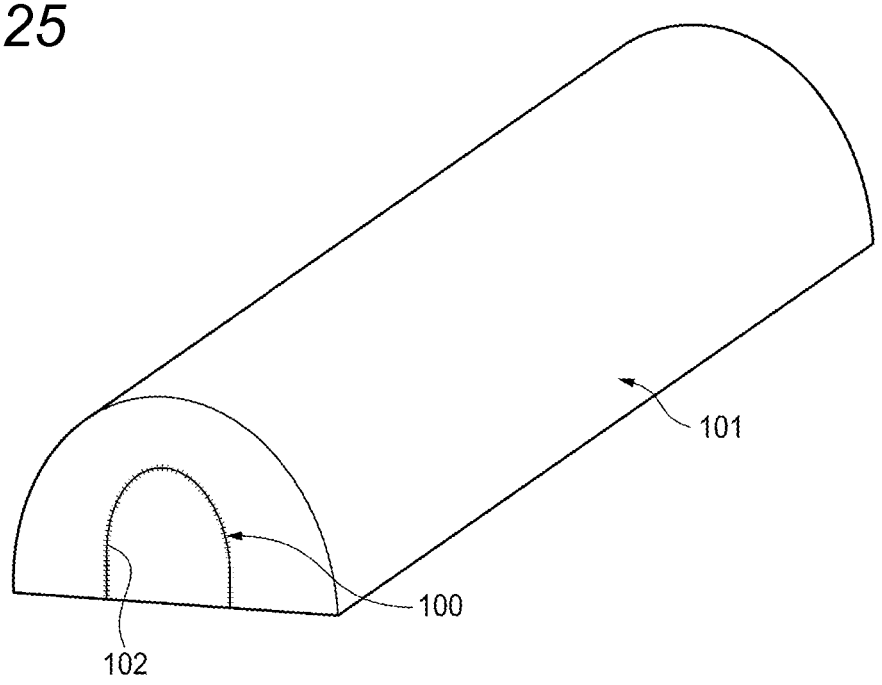
FIG. 25 is an external perspective view showing a tent to which the slider for a slide fastener according to the present invention is applied.
Figure 26:
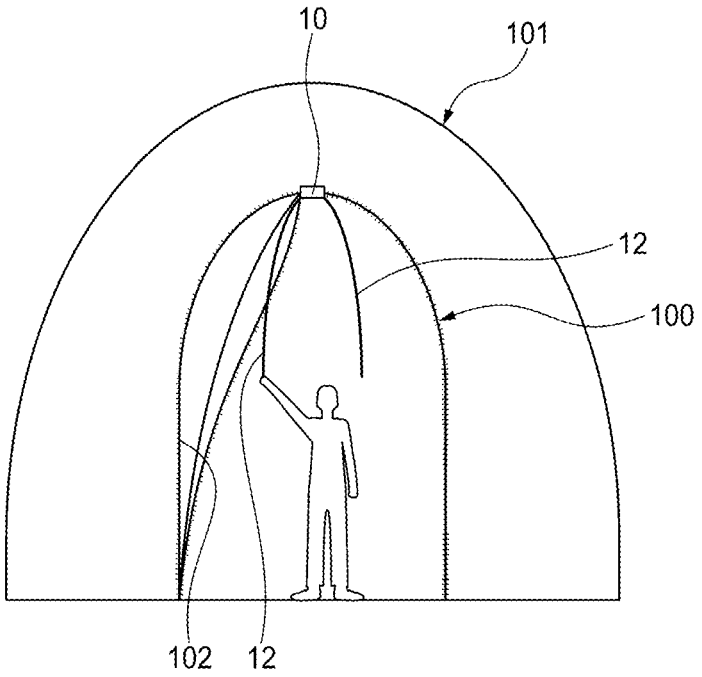
FIG. 26 is an internal perspective view showing a tent to which the slider for a slide fastener according to the present invention is applied.

As a first example, as shown in FIG. 25 and FIG. 26, the slider 10 for a slide fastener may be adapted to a slide fastener 100, which is used in a tent 101 to open and close an inlet 102 of the tent. In this case, while an upper portion of the inlet 102 has the height that a user's hand does not reach, the inlet 102 can be easily opened and closed by a user because he/she can quickly fasten and unfasten the slide fastener 100 only by pulling the string 12 of the slider 10.

Figure 27B:
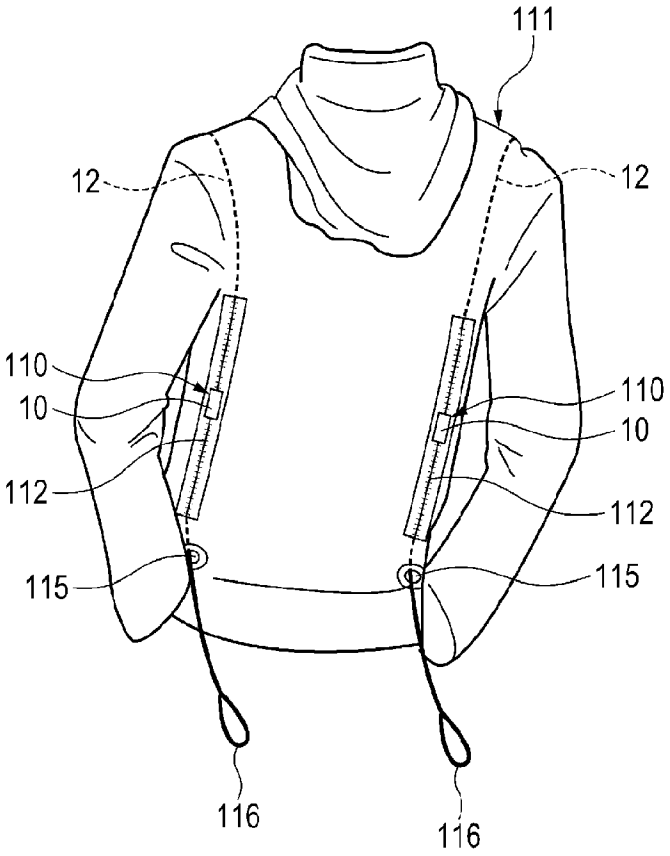
FIG. 27(*a*) and FIG. 27(*b*) are front and rear perspective views showing a jacket to which the slider for a slide fastener according to the present invention is applied.
Figure 27A:
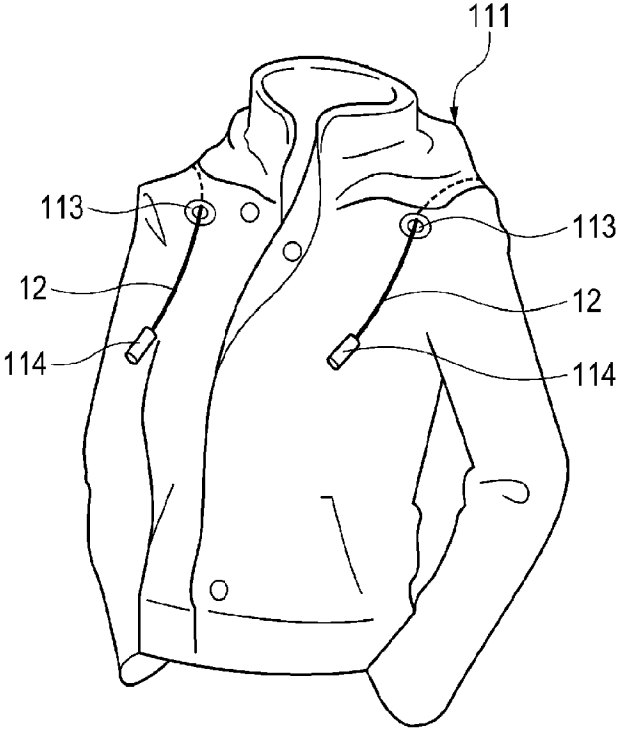

Next, as a second example, as shown in FIG. 27, the slider 10 for a slide fastener may be adapted to a slide fastener 110, which is used in a jacket (clothes) 111 to open and close a pair of air-flowing portions 112 disposed on the back thereof. In this example, the string 12 is disposed inside the jacket 111. The frontal portion of the string 12 is provided with a pull tab 114 and configured such that the frontal portion is drawn outside through a drawing hole 113 which is provided in a shoulder mouth at the front side of the jacket 111. The rear portion of the string 12 is provided with a loop 116 and configured such that the rear portion is drawn outside through a drawing hole 115 which is provided in the back-sided skirt of the jacket 111. In this case, while the air-flowing portions 112 of the jacket 111 is located at a position where it is difficult for a user's hand to reach, the air-flowing portions 112 can be easily opened and closed by a user because he/she can quickly fasten and unfasten the slide fastener 110 only by pulling the pull tab 114 or loop 116 of the string 12.

DESCRIPTION OF REFERENCE NUMERALS

10 Slider for a slide fastener
11 Body
12 String
13 Fixture member
14 Upper blade
15 Lower blade
16 Flange
17 Guide post
19 Mountain-shaped portion
19*a* Opening
20 Slider for a concealed slide fastener
21 Body
22 Lower blade
23 Flange
23*a* Side wall portion
23*b* Upper plate portion
24 Guide post
25 Element guide
30 Slider for a slide fastener
31 Cover
33 String-receiving groove (String-receiving portion)
33*a* Protrusion
35*a* Protrusion
40 Slider for a concealed slide fastener
50 Slider for a slide fastener
51 Cover
52 String-receiving portion
52*a* Protrusion
54*a* Protrusion
60 Slider for a concealed slide fastener
61 Cover
70 Slider for a slide fastener
71 Cover
72 String-receiving portion
72*a* Protrusion
80 Slider for a concealed slide fastener
101 Tent
111 Jacket (Clothes)

The invention claimed is:

1. A slider for a slide fastener comprising:
a body which engages and disengages fastener elements of a pair of fastener stringers; and
a string having pull tabs in longitudinally opposite sides thereof,
wherein the body is provided with a string-receiving portion receiving the string therein and having therein a protrusion for fixing the string, and
wherein a cover which is configured separately from the body is attached to the body so that the string is held between the cover and the string-receiving portion, thereby fixing the string to the body to prevent movement relative to the body.

2. The slider according to claim 1,
wherein the body includes upper and lower blades vertically disposed opposite to each other, and a guide post connecting the upper and lower blades,
wherein at least one of the upper and lower blades is provided, in a surface thereof, with the string-receiving portion, and
wherein the string is fixed to the body by fitting and assembling the cover to the body, the cover having therein a protrusion for fixing the string.

3. The slider according to claim 1,
wherein the body includes upper and lower blades vertically disposed opposite to each other, and a guide post connecting the upper and lower blades,
wherein at least one of the upper and lower blades is provided, in a surface thereof, with the string-receiving portion, and
wherein the string is fixed to the body by fitting and assembling the cover the string-receiving portion, the cover having therein a protrusion for fixing the string.

4. The slider according to claim 1,
wherein the body includes upper and lower blades vertically disposed opposite to each other, and a guide post connecting the upper and lower blades,
wherein at least one of the upper and lower blades is provided, in a surface thereof, with the string-receiving portion, and wherein the string is fixed to the body by sliding and assembling the cover along and to the string-receiving portion.

5. The slider according to claim 1,
wherein a body of the slider includes a lower blade, a pair of left and right flanges having an inverted L-shape in cross section, a guide post, and an element guide,
wherein the pair of left and right flanges has a pair of left and right side wall portions erected along left and right side edges of the lower blade and a pair of left and right upper plate portions extending from upper ends of the left and right side wall portions in a mutually approaching direction, the guide post is erected extending from a frontal-sided transverse central portion of the lower blade between the pair of left and right upper plate portions, and the element guide is provided on an outer circumference of the guide post such that the element guide extends towards inner end surfaces of the left and right upper plate portions, wherein the lower blade is provided in a surface thereof, with the string-receiving portion, and wherein the string is fixed to the body, by fitting and assembling the cover to the body, the cover having therein a protrusion for fixing the string.

6. The slider according to claim 1, wherein a body of the slider includes a lower blade, a pair of left and right flanges having an inverted L-shape in cross section, a guide post, and an element guide, wherein the pair of left and right flanges has a pair of left and right side wall portions erected along left and right side edges of the lower blade and a pair of left and right upper plate portions extending from upper ends of the left and right side wall portions in a mutually approaching direction, the guide post is erected extending from a frontal-sided transverse central portion of the lower blade between the pair of left and right upper plate portions, and the element guide is provided on an outer circumference of the guide post such that the element guide extends towards inner end surfaces of the left and right upper plate portions, wherein the lower blade is provided, in a surface thereof, with the string-receiving portion, and wherein the string is fixed to the body by fitting and assembling the cover to the string-receiving portion, the cover having therein a protrusion for fixing the string.

7. The slider according to claim 1, wherein a body of the slider includes a lower blade, a pair of left and right flanges having an inverted L-shape in cross section, a guide post, and an element guide, wherein the pair of left and right flanges has a pair of left and right side wall portions erected along left and right side edges of the lower blade and a pair of left and right upper plate portions extending from upper ends of the left and right side wall portions in a mutually approaching direction, the guide post is erected extending from a frontal-sided transverse central portion of the lower blade between the pair of left and right upper plate portions, and the element guide is provided on an outer circumference of the guide post such that the element guide extends towards inner end surfaces of the left and right upper plate portions, wherein the lower blade is provided, in a surface thereof, with a string-receiving portion, and wherein the string is fixed to the body by sliding and assembling the cover along and to the string-receiving portion.

8. A tent comprising the slider according to claim 1.

9. A cloth article comprising the slider according to claim 1.

* * * * *